US006384704B1

(12) United States Patent
Motomura

(10) Patent No.: US 6,384,704 B1
(45) Date of Patent: May 7, 2002

(54) TRIGGER COIL

(75) Inventor: Katsumi Motomura, Asaka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/950,593

(22) Filed: Sep. 13, 2001

(30) Foreign Application Priority Data

Sep. 13, 2000 (JP) ..... 12-277423

(51) Int. Cl.[7] ..... H01F 27/29
(52) U.S. Cl. ..... 336/192; 336/182; 336/198; 336/208
(58) Field of Search ..... 336/182, 192, 336/198, 208

(56) References Cited

U.S. PATENT DOCUMENTS 5,266,916 A * 11/1993 Kijima ..... 336/160

FOREIGN PATENT DOCUMENTS

JP 5-82032 11/1993

* cited by examiner

*Primary Examiner*—Ramon M. Barrera
(74) *Attorney, Agent, or Firm*—Young & Thompson

(57) ABSTRACT

A trigger coil has a primary winding, a secondary winding, a package incorporating therein both the primary winding and the secondary winding, and a common terminal to which one end of the primary winding and one end of the secondary winding are connected. One end of the primary winding is connected to an exit portion of said common terminal at a side to be connected to the circuit substrate, and one end of the secondary winding is connected to an exit portion of said common terminal at a side apart from the circuit substrate.

1 Claim, 3 Drawing Sheets

TRIGGER COIL

BACKGROUND OF THE INVENTION

1. Field of the Invention

The present invention relates to a trigger coil for generating a trigger voltage to be applied to a trigger electrode of a flashlight emitting tube.

2. Description of the Related Art

Hitherto, there is known a camera in which when a subject brightness is insufficient, a photography is performed while a flashlight is emitted in synchronism with a shutter operation. Such a camera is provided with a flashlight generating circuit for generating a flashlight. The flashlight generating circuit comprises a booster circuit, a main capacitor for storing an electric power boosted by the booster circuit, a flashlight emitting tube for emitting a flashlight by the electric power emanated from the main capacitor, and a trigger coil for generating a trigger voltage to be applied to a trigger electrode of the flashlight emitting tube.

The trigger coil comprises a primary winding, a secondary winding and a package incorporating both the primary winding and the secondary winding. For example, the number of turns of the primary winding and the number of turns of the secondary winding are 20 turns and 500 turns, respectively. And a diameter of the primary winding and a diameter of the secondary winding are Φ0.2 and Φ0.05, respectively.

In the trigger coil as mentioned above, there are two types of trigger coil one of which is directed to a four-terminal type of trigger coil having total four terminals consisting of two terminals of the primary winding and two terminals of the secondary winding, and another being directed to a three-terminal type of trigger coil having total three terminals consisting of a common terminal in which one end of the primary winding is connected to one end of the secondary winding on a common basis and two terminals of the primary winding and the secondary winding. Particularly, in case of the threeterminal type of trigger coil, the primary winding, which is relatively large in diameter, and the secondary winding, which is relatively small in diameter, are wound at the same place of the common terminal and are mounted on a circuit substrate by soldering. This involves such a problem that the slight external force disconnects the secondary winding, which is relatively small in diameter.

SUMMARY OF THE INVENTION

In view of the foregoing, it is an object of the present invention to provide a trigger coil intended to preventing disconnection of the secondary winding.

To achieve the above-mentioned object, the present invention provides a trigger coil comprising a primary winding, a secondary winding, a package incorporating therein both the primary winding and the secondary winding, a common terminal to which one end of the primary winding and one end of the secondary winding are connected, a primary terminal to which another end of the primary winding is connected, and a secondary terminal to which another end of the secondary winding is connected, wherein a current conducts between the primary terminal and the common terminal to generate on the secondary terminal a trigger voltage to be applied to a trigger electrode of a flashlight emitting tube, characterized in that said common terminal has a pin-like shape extending to pass through the package, one end of which is connected to a circuit substrate, and one end of the primary winding is connected to an exit portion of said common terminal from the package at a side to be connected to the circuit substrate, and one end of the secondary winding is connected to an exit portion of said common terminal from the package at a side apart from the circuit substrate.

An important feature of the trigger coil of the present invention resides in the point that one end of the primary winding is connected to an exit portion of said common terminal at a side to be connected to the circuit substrate, and one end of the secondary winding is connected to an exit portion of said common terminal at a side apart from the circuit substrate. Even if the trigger coil is mounted on the circuit substrate and the external force is applied thereto, as compared with a conventional trigger coil in which a primary winding involved in the larger diameter and a secondary winding involved in the smaller diameter are wound on the same place of the common terminal, it is expected that an affect of the external force onto one end of the secondary winding is small. Thus, it is possible to prevent a disconnection of the secondary winding.

DETAILED DESCRIPTION OF PREFERRED EMBODIMENTS

Embodiments of the present invention will be described with reference to the accompanying drawings.

Figure 1A:
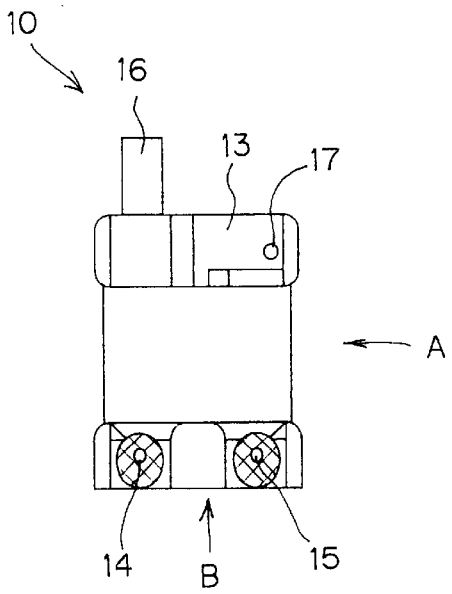
FIG. 1(*a*) to FIG. 1(*c*) are views showing states in which a trigger coil according to an embodiment of the present invention is looked at from three directions, respectively, and FIG. 1(*d*) is a perspective view of the trigger coil.
Figure 1B:
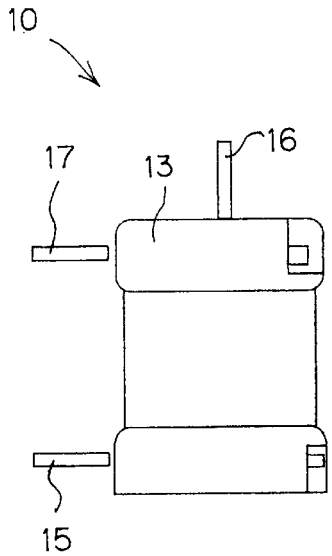
Figure 1C:
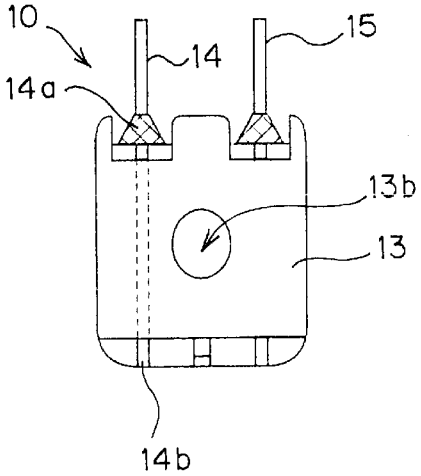
Figure 1D:
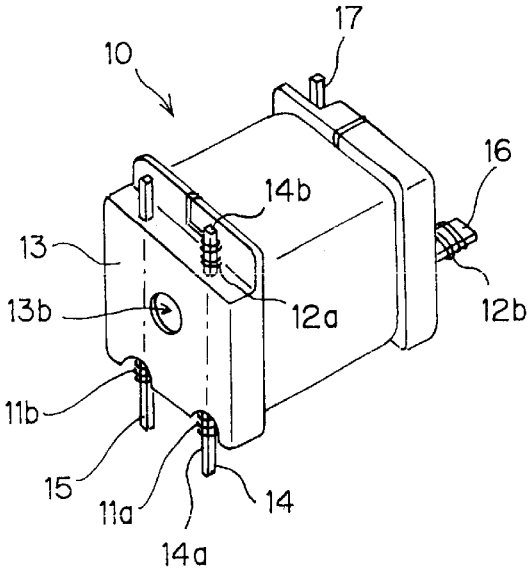
Figure 2:
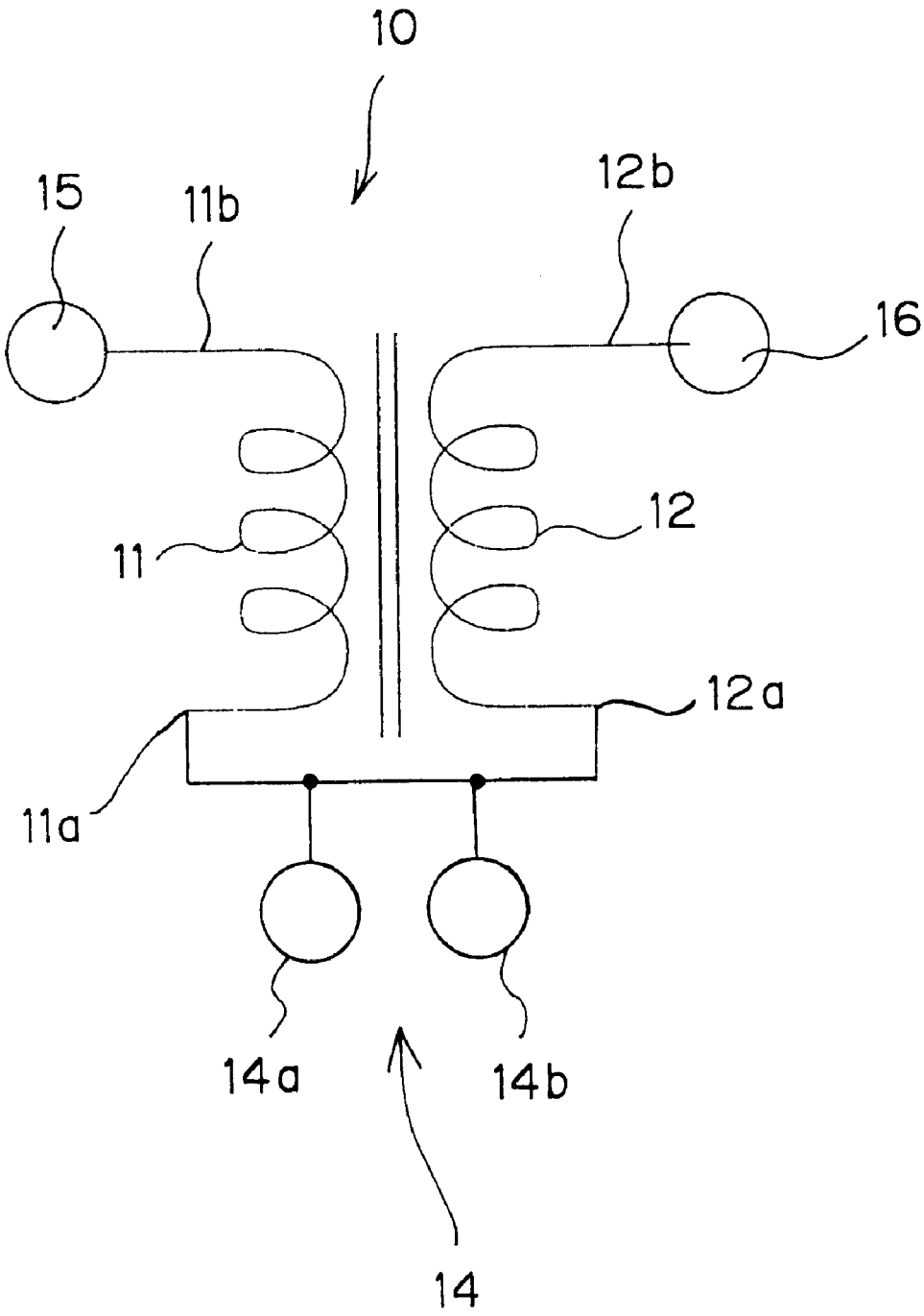
FIG. 2 is an equivalent circuit of the trigger coil shown in FIG. 1.

FIG. 1(*a*) to FIG. 1(*c*) are views showing states in which a trigger coil according to an embodiment of the present invention is looked at from three directions, respectively, and FIG. 1(*d*) is a perspective view of the trigger coil. FIG. 2 is an equivalent circuit of the trigger coil shown in FIG. 1.

FIG. 1(*a*) shows a state that terminals 14 and 15, which constitute a trigger coil 10 according to an embodiment of the present invention, are looked at from the top. FIG. 1(*b*) shows a state that the trigger coil 10 shown in FIG. 1(*a*) is looked at from a direction of an arrow A. FIG. 1(*c*) shows a state that the trigger coil 10 shown in FIG. 1(*a*) is looked at from a direction of an arrow B. FIG. 1(*d*) is a perspective view of the trigger coil 10.

The trigger coil 10 comprises a primary winding 11 and a secondary winding 12, as shown in FIG. 2, and a molding member 13 (corresponding to the package referred to in the present invention) incorporated therein both the primary winding 11 and the secondary winding 12. The number of the primary winding 11 is less than that of the secondary winding 12. A diameter of the primary winding 11 is Φ0.35 and a diameter of the secondary winding 12 is Φ0.05.

The trigger coil 10 further comprises, as shown in FIG. 1(*d*) and FIG. 2, a common terminal 14 as a metal rod having an exit portion 14*a* to which an end 11*a* (a winding termination end) of the primary winding 11 is connected, and an exit portion 14*b* to which an end 12*a* (a winding termination end) of the secondary winding 12 is connected.

The trigger coil 10 furthermore comprises a primary terminal 15 as a metal rod to which another end 11*b* (a winding initiation end) of the primary winding 11 is connected, and a secondary terminal 16 as a metal rod to which another end 12*b* (a winding initiation end) of the secondary winding 12 is connected. The trigger coil 10 still further comprises a vacant pin (NC) 17 for stably mounting the trigger coil 10 on a circuit substrate (not illustrated) provided below the trigger coil 10 shown in FIG. 1(*d*). The trigger coil 10 generates on the secondary terminal 16 a trigger voltage to be applied to a trigger electrode of a flashlight emitting tube (which will be described latter) by means of conducting a current between the primary terminal 15 and the common terminal 14.

The common terminal 14, which constitutes the trigger coil 10, as shown in FIG. 1(*c*) and FIG. 1(*d*), has a pin-like shape extending to pass through the molding member 13, one end of which is connected to the circuit substrate. As mentioned above, one end 11*a* of the primary winding 11 is connected to the exit portion 14*a* of the common terminal 14 from the molding member 13 at the side to be connected to the circuit substrate. And one end 12*a* of the secondary winding 12 is connected to the exit portion 14*b* of the common terminal 14 from the molding member 13 at the side apart from the circuit substrate. The molding member 13, which constitutes the trigger coil 10, has an aperture 13*b* into which a rod-like shape of core (not illustrated) is inserted.

In the trigger coil 10 thus constructed, one end 11*a* of the primary winding 11 is connected to the exit portion 14*a* of the common terminal 14 at the side to be connected to the circuit substrate. And one end 12*a* of the secondary winding 12 is connected to the exit portion 14*b* of the common terminal 14 at the side apart from the circuit substrate. Thus, even if the trigger coil 10 is mounted on the circuit substrate and the external force is applied thereto, as compared with a conventional trigger coil in which a primary winding involved in the larger diameter and a secondary winding involved in the smaller diameter are wound on the same place of the common terminal, it is expected that an affect of the external force onto the one end 12*a* of the secondary winding 12 is small. Thus, it is possible to prevent a disconnection of the secondary winding 12.

Next, there will be described a case where the trigger coil 10 is incorporated into a flashlight generation circuit which is mounted on a camera.

Figure 3:
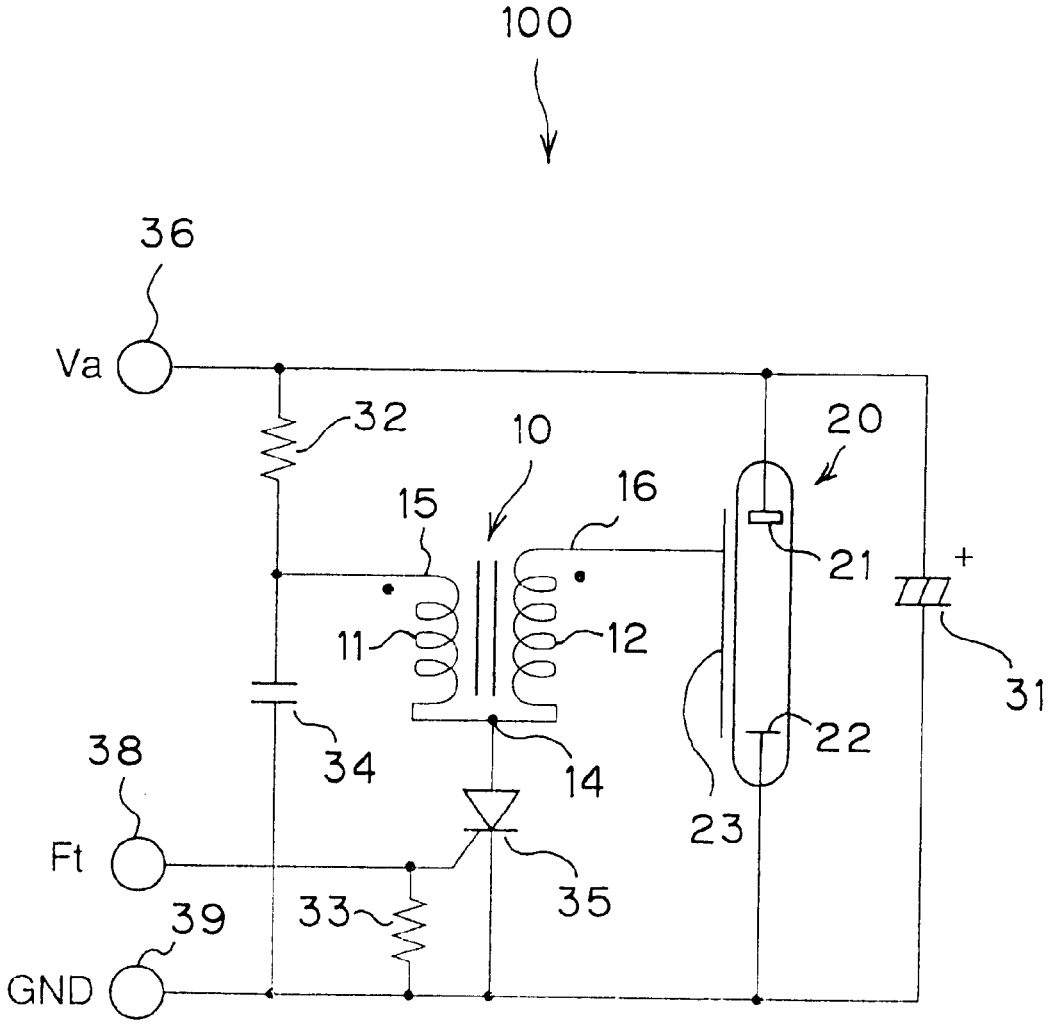
FIG. 3 is a view of a flashlight generation circuit into which the trigger coil shown in FIG. 1 is incorporated.

FIG. 3 is a view of a flashlight generation circuit into which the trigger coil shown in FIG. 1 is incorporated.

A flashlight generation circuit 100 shown in FIG. 3 comprises the trigger coil 10, as shown in FIG. 1, a flashlight emitting tube 20, a main capacitor 31, resistance elements 32 and 33, a trigger capacitor 34, a thyristor 35, and terminals 36, 38 and 39.

The flashlight generation circuit 100 is mounted on a camera as mentioned above. A voltage Va, which is boosted by a booster circuit connected to a built-in battery for controlling the camera in its entirety, is applied to a terminal 36. Between the terminal 36 and a terminal 39 held in the ground GND potential, the resistance element 32 and the trigger capacitor 34 connected in series, the flashlight emitting tube 20, and the main capacitor 31 are connected in parallel with one another. The flashlight emitting tube 20 comprises an anode 21, a cathode 22 and a trigger electrode 23. Inside the flashlight emitting tube 20, a xenon gas is included.

The primary terminal 15, in which the primary winding 11 constituting the trigger coil 10 is wound, is connected to a connecting point of the resistance element 32 with the trigger capacitor 34. The primary terminal 16, in which the secondary winding 12 constituting the trigger coil 10 is wound, is connected to a trigger electrode 23 of the flashlight emitting tube 20. The common terminal 14 constituting the trigger coil 10 is connected via the thyristor 35 to the terminal 39. A gate of the thyristor 35 is connected to a terminal 38 to which a control signal Ft is fed, and also connected via the resistance element 33 to the terminal 39.

The flashlight generation circuit 100 first receives at the terminal 38 an 'L' level of control signal Ft. A voltage Va applied to the terminal 36 causes the main capacitor 31 to store a sufficient electric power. Further, the trigger capacitor 34 also stores an electric power via a path of the terminal 36—the resistance 32—the trigger capacitor 34—the terminals 39.

Next, when the photography is performed, an 'H' level of control signal Ft is applied to the terminal 38 in synchronism with an operation of a shutter of a camera. As a result, the thyristor 35 turns on, so that an electric power stored in the trigger capacitor 34 is discharged via the path of the primary winding 11—the thyristor 35—the terminal 39. Thus, a current conducts through the primary winding 11 so that an electromotive force is introduced on the secondary winding 12. Since the number of turns of the secondary winding 12 is larger than that of the primary winding 11, the electromotive force introduced on the secondary winding 12 is amplified. In this manner, the large electromotive force is applied in form of a trigger voltage to a trigger electrode 23 of the flashlight emitting tube 20. Thus the xenon gas included in the flashlight emitting tube 20 is excited, and the electric power stored in the main capacitor 31 is discharged through a discharge loop of a (+) side of the main capacitor 31—the anode 21—the cathode 22—a (–) side of the main capacitor 31, so that a flashlight is emitted from the flashlight emitting tube 20. Thus, in a case where a subject brightness is short, a photography is performed through emission of the flashlight from the flashlight generation circuit 100 mounted on a camera.

As mentioned above, according to the present invention, it is possible to prevent a disconnection of the secondary winding constituting the trigger coil.

While the present invention has been described with reference to the particular illustrative embodiments, it is not to be restricted by those embodiments but only by the appended claims. It is to be appreciated that those skilled in the art can change or modify the embodiments without departing from the scope and sprit of the present invention.

What is claimed is:

1. A trigger coil comprising a primary winding, a secondary winding, a package incorporating therein both the primary winding and the secondary winding, a common terminal to which one end of the primary winding and one end of the secondary winding are connected, a primary terminal to which another end of the primary winding is connected, and a secondary terminal to which another end of the secondary winding is connected, wherein a current conducts between the primary terminal and the common terminal to generate on the secondary terminal a trigger voltage to be applied to a trigger electrode of a flashlight emitting tube, characterized in that said common terminal has a pin-like shape extending to pass through the package, one end of which is connected to a circuit substrate, and one end of the primary winding is connected to an exit portion of said common terminal from the package at a side to be connected to the circuit substrate, and one end of the secondary winding is connected to an exit portion of said common terminal from the package at a side apart from the circuit substrate.

* * * * *

UNITED STATES PATENT AND TRADEMARK OFFICE

CERTIFICATE OF CORRECTION

PATENT NO. : 6,384,704 B1
DATED : May 7, 2002
INVENTOR(S) : Katsumi Motomura

It is certified that error appears in the above-identified patent and that said Letters Patent is hereby corrected as shown below:

Title page,
Item [30], Foreign Application Priority Data, change "12-277423" to
-- 2000-277423 --

Signed and Sealed this

Seventeenth Day of September, 2002

*Attest:*

*Attesting Officer*

JAMES E. ROGAN
*Director of the United States Patent and Trademark Office*